US011808266B2

(12) United States Patent
Torimoto et al.

(10) Patent No.: US 11,808,266 B2
(45) Date of Patent: Nov. 7, 2023

(54) SUBMERSIBLE PUMP

(71) Applicant: Tsurumi Manufacturing Co., Ltd., Osaka (JP)

(72) Inventors: Yasushi Torimoto, Yawata (JP); Hisakazu Shinya, Yonago (JP); Yutaka Terada, Yawata (JP)

(73) Assignee: Tsurumi Manufacturing Co., Ltd., Osaka (JP)

( * ) Notice: Subject to any disclaimer, the term of this patent is extended or adjusted under 35 U.S.C. 154(b) by 0 days.

(21) Appl. No.: 18/014,961

(22) PCT Filed: Feb. 24, 2021

(86) PCT No.: PCT/JP2021/006941
§ 371 (c)(1),
(2) Date: Jan. 6, 2023

(87) PCT Pub. No.: WO2022/009460
PCT Pub. Date: Jan. 13, 2022

(65) Prior Publication Data

US 2023/0193904 A1 Jun. 22, 2023

(30) Foreign Application Priority Data

Jul. 9, 2020 (JP) ..... 2020-118677

(51) Int. Cl.
*F04D 13/06* (2006.01)
*F04D 29/42* (2006.01)

(52) U.S. Cl.
CPC ..... *F04D 13/0606* (2013.01); *F04D 29/426* (2013.01); *F04D 29/428* (2013.01)

(58) Field of Classification Search
CPC ..... F04D 13/08; F04D 29/40; F04D 29/406; F04D 29/42; F04D 29/426; F04D 29/428;
(Continued)

(56) References Cited

U.S. PATENT DOCUMENTS

2021/0115927 A1* 4/2021 Olsson ..... F04D 13/08

FOREIGN PATENT DOCUMENTS

JP 36-14685 B1 8/1961
JP 52-64906 U 5/1977
(Continued)

OTHER PUBLICATIONS

Author: Tsurumi Pump Title: KTZ-series dewatering pumps Date published: Mar. 2013 or Jun. 7, 2018 Date accessed: Apr. 26, 2023 Link:https://www.technosub.net/RadFiles/Documents/DOCUMENTS/FICHE_TECHNIQUE_LIBRE/15181/KTZ35.5_Technicaldata.pdf (Year: 2018).*

(Continued)

*Primary Examiner* — Charles G Freay
*Assistant Examiner* — Chirag Jariwala
(74) *Attorney, Agent, or Firm* — Crowell & Moring LLP

(57) ABSTRACT

A submersible pump (100) is a submersible pump (100) in which a one-sided waterway (6) extending along a rotation shaft (1) is provided on one side of a submersible pump main body (100*a*), and includes an impeller (4); and a pump casing (5) in which the impeller (4) is arranged, in which the pump casing (5) includes a tongue portion (53) that is arranged between a pump chamber (5*a*) in which the impeller (4) is arranged and an inlet opening (6*a*) of the one-sided waterway (6) when viewed from an axial direction of the rotation shaft (1), and a connection waterway (54) that is provided between the tongue portion (53) and an inner surface (55) of the pump casing (5), and is directly connected to the inlet opening (6*a*) from an upstream side when viewed from the axial direction of the rotation shaft (1).

9 Claims, 5 Drawing Sheets

(58) Field of Classification Search
CPC .. F04D 29/4293; F04D 29/58; F04D 29/5806; F04D 29/586; F04D 29/588
See application file for complete search history.

(56) References Cited

FOREIGN PATENT DOCUMENTS

| | | | | | | |
|---|---|---|---|---|---|---|
| JP | 52-160102 | U | | 12/1977 | | |
| JP | 53-58801 | A | | 5/1978 | | |
| JP | 3-87890 | U | | 9/1991 | | |
| JP | 5-321867 | A | | 12/1993 | | |
| JP | H0610895 | A | * | 1/1994 | ..... | F04D 13/08 |
| JP | H0722097 | U | * | 4/1995 | ..... | F04D 13/08 |
| JP | H07293496 | A | * | 11/1995 | ..... | F04D 13/08 |
| JP | 2516341 | Y2 | | 11/1996 | | |
| JP | 10-184581 | A | | 7/1998 | | |
| JP | H10184581 | A | * | 7/1998 | ..... | F04D 13/08 |
| JP | 11-294395 | A | | 10/1999 | | |
| JP | 2015025367 | A | * | 2/2015 | ..... | F04D 13/08 |
| JP | 2017-115593 | A | | 6/2017 | | |
| JP | 2018-91153 | A | | 6/2018 | | |
| KR | 200467740 | Y1 | * | 7/2013 | ..... | F04D 13/08 |
| WO | WO 2018/096832 | A1 | | 5/2018 | | |

OTHER PUBLICATIONS

International Search Report (PCT/ISA/210) issued in PCT Application No. PCT/JP2021/006941 dated Apr. 20, 2021 with English translation (seven (7) pages).

Japanese-language Written Opinion (PCT/ISA/237) issued in PCT Application No. PCT/JP2021/006941 dated Apr. 20, 2021 (five (5) pages).

Japanese-language Notice of Reasons for Refusal issued in Japanese Application No. 2020-118677 dated Dec. 14, 2021 with English translation (four (4) pages).

Japanese-language Decision to Grant a Patent issued in Japanese Application No. 2020-118677 dated Jan. 5, 2022 with English translation (five (5) pages).

* cited by examiner

SUBMERSIBLE PUMP

TECHNICAL FIELD

The present invention relates to a submersible pump.

BACKGROUND ART

In the related art, a submersible pump including an impeller is known. Such a submersible pump is disclosed in Japanese Utility Model Publication No. 3-87890.

In Japanese Utility Model Publication No. 3-87890 described above, a submersible motor pump (so-called one-sided waterway pump) in which a flow path extending along a rotation shaft is provided on one side of a submersible pump main body is disclosed. The submersible motor pump is configured to suck water from a suction port provided in a pump casing by rotating an impeller provided at a lower end of the rotation shaft, and send water toward an upper discharge port via a flow path on one side of the submersible pump main body.

CITATION LIST

Patent Literature

[PTL 1] Japanese Utility Model Publication No. 3-87890

SUMMARY OF INVENTION

Technical Problem

Although not specified in Japanese Utility Model Publication No. 3-87890, in the field of a submersible pump (so-called one-sided waterway pump) in which a flow path is provided on one side of the submersible pump main body, in the related art, it has been desired to increase the total head, and there is a problem of how to increase the total head. Even in the submersible motor pump disclosed in Japanese Utility Model Publication No. 3-87890, there is a problem of how to increase the total head.

The present invention has been made in order to solve the above-mentioned problems, and an object of the present invention is to provide a submersible pump capable of increasing the total head.

Solution to Problem

In order to achieve the object, a submersible pump in an aspect of the invention is a submersible pump in which a one-sided waterway extending along a rotation shaft is provided on one side of a submersible pump main body, and includes an impeller attached to one end of the rotation shaft; and a pump casing in which the impeller is arranged, in which the pump casing includes a tongue portion that is arranged between a pump chamber in which the impeller is arranged and an inlet opening of the one-sided waterway when viewed from an axial direction of the rotation shaft, and a connection waterway that is provided between the tongue portion and an inner surface of the pump casing, and is directly connected to the inlet opening from an upstream side when viewed from the axial direction of the rotation shaft.

In the submersible pump according to the one aspect of the invention, as described above, the pump casing is provided with the tongue portion that is arranged between the pump chamber in which the impeller is arranged and the inlet opening of the one-sided waterway when viewed from the axial direction of the rotation shaft, and the connection waterway that is provided between the tongue portion and the inner surface of the pump casing, and is directly connected to the inlet opening from the upstream side when viewed from the axial direction of the rotation shaft. Thereby, the pump chamber and the one-sided waterway can be connected to each other via the connection waterway. Therefore, as compared with a case where the pump chamber and the one-sided waterway are directly connected, in the connection waterway provided immediately before the one-sided waterway, since the water flow (flow path sectional area) is narrowed down and the water flow is regulated, water can smoothly flow into the one-sided waterway at a faster speed. As a result, the total head of the submersible pump can be further increased.

In the submersible pump according to the one aspect, it is preferable that the one-sided waterway is formed such that a flow path sectional area is gradually decreased from a downstream side toward the inlet opening on the upstream side. With this configuration, in the inlet opening of the one-sided waterway, the water flow (flow path sectional area) can be narrowed down, so that water can flow into the one-sided waterway at a faster speed. Further, by changing the flow path sectional area of the one-sided waterway so that the flow path sectional area is gradually decreased instead of being suddenly changed, it is possible to suppress the water flow from being disturbed by the sudden change of the flow path sectional area. As a result, the total head of the submersible pump can be further increased.

In this case, it is preferable that a motor including a motor frame provided to the pump casing from a side opposite to a suction port in the axial direction is further provided, and the one-sided waterway is formed to straddle the motor frame and the pump casing, and is formed such that the flow path sectional area is gradually decreased from the motor frame on the downstream side toward the pump casing on the upstream side. With this configuration, not only the one-sided waterway provided in the pump casing but also the one-sided waterway provided in the motor frame can be formed so that the flow path sectional area is gradually decreased, and therefore, the one-sided waterway can be formed over a relatively large range such that the flow path sectional area is gradually decreased. Therefore, the sudden change of the flow path sectional area can be further suppressed, and thus the total head of the submersible pump can be further increased.

In the submersible pump according to the one aspect, it is preferable that the impeller includes a plate-shaped portion, and a blade portion provided on a suction port side of the plate-shaped portion, and a portion on an inner peripheral side of the blade portion is inclined toward an outer peripheral side. With this configuration, on the inner peripheral side of the blade portion, a larger opening portion on the inner peripheral side where water is first taken into a portion between the blade portions via the suction port can be secured by inclining the blade portion toward the outer peripheral side. Therefore, the loss on the large flow rate side can be reduced by improving the suction performance, and the lift on the large flow rate side can be increased.

In this case, it is preferable that the blade portion is formed such that a size of the blade portion in the axial direction is gradually decreased from the inner peripheral side toward the outer peripheral side of the impeller, and a facing surface of the pump casing facing the blade portion is inclined from the inner peripheral side toward the outer peripheral side of the impeller corresponding to the size of the blade portion in the axial direction, which is gradually decreased, when viewed from a direction orthogonal to the axial direction. With this configuration, the loss can be reduced by changing an area ratio between the inlet side and the outlet side in the pump casing, and therefore the total head of the submersible pump can be further increased.

In the configuration in which the portion on the inner peripheral side of the blade portion is inclined toward the outer peripheral side, it is preferable that the impeller is formed such that a flow path sectional area of a waterway formed between the blade portions is gradually decreased from the inner peripheral side to the outer peripheral side of the impeller. With this configuration, the outer diameter of the impeller can be increased by making the blade width on the outer peripheral side (outlet side) smaller than the blade width on the inner peripheral side (inlet side), and therefore the total head of the submersible pump in the small flow rate range can be further increased.

In the submersible pump according to the one aspect, it is preferable that a motor including a motor frame provided to the pump casing from a side opposite to a suction port in the axial direction is further provided, and an inner surface of the one-sided waterway is formed in a smooth shape without a step between the motor frame and a discharge port. With this configuration, unlike a case where there is a step, it is possible to prevent a water flow passing through the one-sided waterway from being disturbed, and thus the total head of the submersible pump can be further increased.

In the submersible pump according to the one aspect, it is preferable that the tongue portion extends toward the upstream side of the inlet opening so that the vicinity of a center of the pump chamber is partitioned off from the inlet opening of the one-sided waterway when viewed from the axial direction of the rotation shaft. With this configuration, the connection waterway can be arranged to extend in a direction along the water flow generated in the pump chamber by the impeller instead of in a direction in which the vicinity of the center of the pump chamber and the inlet opening of the one-sided waterway are directly connected. Therefore, water can flow smoothly from the pump chamber to the connection waterway at a higher speed, and therefore, the total head of the submersible pump can be further increased.

In the submersible pump according to the one aspect, it is preferable that the pump casing includes a surface that is formed on the other end side of the rotation shaft with respect to the connection waterway, and forms the connection waterway, and the surface forming the connection waterway connects the tongue portion and the inner surface of the pump casing to each other when viewed from the axial direction of the rotation shaft. With this configuration, the number of components can be reduced and the device configuration can be simplified as compared with a case where the upper surface that forms the connection waterway by connecting the tongue portion and the inner surface of the pump casing when viewed from the axial direction of the rotation shaft is configured by a lid-shaped separate member different from the pump casing.

In the configuration in which the flow path sectional area of the one-sided waterway is gradually decreased from the downstream side toward the upstream side, it is preferable that the motor frame is provided with a reduced portion of which an external shape is gradually decreased from the downstream side toward the upstream side along with the flow path sectional area of the one-sided waterway being gradually decreased from the motor frame on the downstream side toward the pump casing on the upstream side. With this configuration, the fixing member for the pump casing and the motor frame can be arranged at a position closer to the one-sided waterway, by the space around the reduced portion, which is secured on the pump casing side by the reduced portion. Therefore, water leakage from between the pump casing and the motor frame can be effectively suppressed by firmly fixing the pump casing and the motor frame.

Advantageous Effects of Invention

According to the present invention, as described above, it is possible to provide a submersible pump capable of further increasing the total head.

DESCRIPTION OF EMBODIMENTS

Hereinafter, embodiments will be described with reference to the drawings.

Embodiment (Configuration of Submersible Pump)

A submersible pump 100 of the present embodiment will be described with reference to FIGS. 1 to 3. The submersible pump 100 is a vertical electric pump in which a center axis of rotation $\alpha$ of a rotation shaft 1 extends in a vertical direction (Z direction). Further, the submersible pump 100 is a so-called one-sided waterway pump in which a one-sided waterway 6 extending along the rotation shaft 1 is provided on one side of a submersible pump main body 100*a*. As an example, the submersible pump 100 of the present embodiment is used at a site where a particularly large total head is required, such as a tunnel work site in a mountain.

Figure 1:
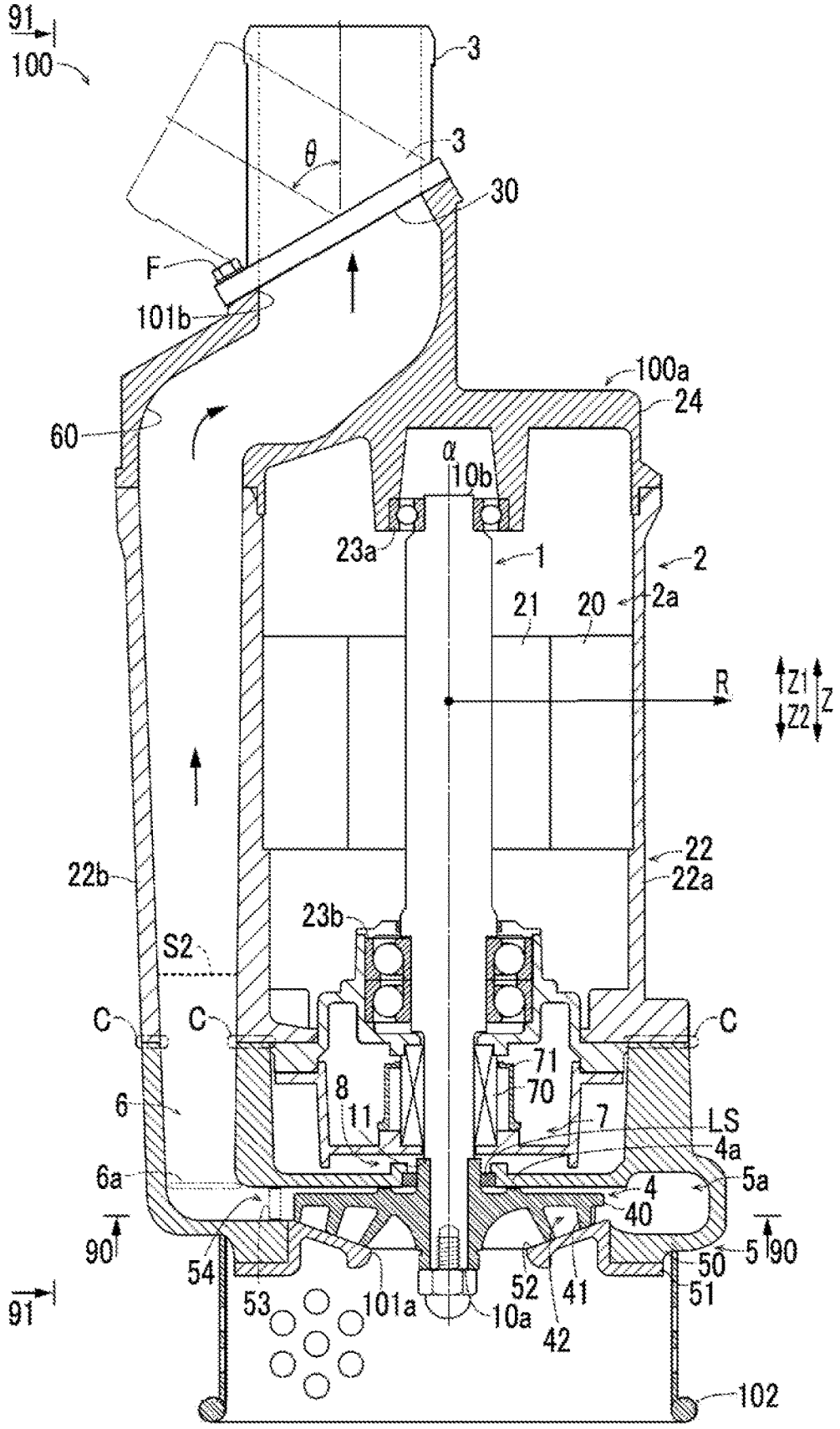
FIG. 1 is a schematic view illustrating an overall configuration of a submersible pump according to an embodiment.

The one-sided waterway 6 illustrated in FIG. 1 is a waterway through which water in a pump chamber 5*a* flows toward a discharge port 101*b*. The one-sided waterway 6 is formed to straddle each member of a pump casing 5, a motor frame 22, and a bracket 24, which will be described later. That is, a portion of the uppermost stream of the one-sided waterway 6 is formed in the pump casing 5. A portion of the downmost stream of the one-sided waterway 6 is formed in the bracket 24. A portion of the one-sided waterway 6 located between the pump casing 5 and the bracket 24 is formed in the motor frame 22.

In each figure, a direction in which the center axis of rotation a of the rotation shaft 1 extends is indicated by the Z direction, a direction facing a motor 2 side from an impeller 4 side in the Z direction is indicated by a Z1 direction (upward), and the opposite direction to the Z1 direction (downward) is indicated by a Z2 direction. Further, a radial direction of the rotation shaft 1 (impeller 4) is indicated by an R direction. The R direction is orthogonal to the Z direction.

The submersible pump 100 includes the rotation shaft 1, the motor 2, a hose coupling 3 attached to the discharge port 101*b*, the impeller 4, the pump casing 5 in which the impeller 4 is arranged, and the above-mentioned one-sided waterway 6. At a lower portion of the submersible pump 100, a strainer 102 that prevents the suction of foreign matter and functions as a stand for the submersible pump 100 to stand upright is provided. In some cases, a pipe is connected to the discharge port 101*b* without providing the hose coupling 3.

(Configuration of Rotation Shaft)

The rotation shaft 1 generally has a cylindrical shape extending in the vertical direction (Z direction). The impeller 4 is attached to one end 10*a* (lower end) of the rotation shaft 1 in the Z2 direction, and the motor 2 (rotor 21) is fixed to the other end 10*b* (upper end) side of the rotation shaft 1 in the Z1 direction. The rotation shaft 1 has a function of transmitting the driving force of the motor 2 to the impeller 4.

The rotation shaft 1 has a contact surface 11 that abuts on the end surface of the impeller 4 in the Z1 direction. The contact surface 11 has a function of positioning the impeller 4 with respect to the rotation shaft 1 in the Z direction. Further, the rotation shaft 1 is configured such that the impeller 4 is fitted from the lower side of the rotation shaft 1 and a key member (not illustrated) is installed in a gap between the rotation shaft 1 and the impeller 4. Thereby, the rotation shaft 1 is configured so that the impeller 4 is positioned with respect to the rotation shaft 1. As a result, the rotations of the rotation shaft 1 and the impeller 4 are synchronized.

(Configuration of Motor)

The motor 2 is configured to rotationally drive the rotation shaft 1. The motor 2 is configured to rotationally drive the impeller 4 via the rotation shaft 1. Specifically, the motor 2 includes a stator 20 having a coil, the rotor 21 arranged on the inner peripheral side of the stator 20, the motor frame 22, an upper bearing 23*a*, a lower bearing 23*b*, and the bracket 24. The rotation shaft 1 is also included in the motor 2.

The rotation shaft 1 is fixed to the rotor 21. The motor 2 is configured to rotationally drive the rotation shaft 1 together with the rotor 21 by generating a magnetic field with the stator 20. The motor frame 22 covers the stator 20 and the rotor 21. The upper bearing 23*a* and the lower bearing 23*b* rotatably support the upper side and the lower side of the rotation shaft 1, respectively. The upper bearing 23*a* is installed on the bracket 24. The bracket 24 is fixed to the motor frame 22 from above. The lower bearing 23*b* is configured of two angular contact ball bearings that are vertically overlapped with each other and have different orientations from each other. By configuring the lower bearing 23*b* in this way, it is possible to handle axial loads with different orientations in both directions, and it is possible to handle axial loads in any cases of the small flow rate side and the large flow rate side.

The motor frame 22 is installed with respect to the pump casing 5 from the side (upper side) opposite to a suction port 101*a* side in the axial direction (Z direction) of the rotation shaft 1. The motor frame 22 has a frame portion 22*a* forming a motor chamber 2*a* in which the stator 20 and the rotor 21 are arranged, and a frame portion 22*b* forming a portion of the one-sided waterway 6.

Both the frame portion 22*a* and the frame portion 22*b* are formed in a cylindrical shape provided with through-holes penetrating the frame portions in the vertical direction. The frame portion 22*b* is arranged on the outer peripheral side of the frame portion 22*a* in the radial direction (R direction) of the rotation shaft 1 (impeller 4).

The bracket 24 forms a portion of the downmost stream of the one-sided waterway 6. The bracket 24 is provided with the discharge port 101*b* that is inclined with respect to a horizontal direction (direction orthogonal to the Z direction). The hose coupling 3 is attached to the bracket 24 from above so as to cover the discharge port 101*b*.

(Configuration of Hose Coupling)

The hose coupling 3 has a shape obtained by cutting a cylindrical shape diagonally. That is, the hose coupling 3 has an inclined end surface 30 that is inclined with respect to a direction in which the cylindrical shape extends.

The hose coupling 3 is fixed to the bracket 24 by a fixing member F. The inclined end surface 30 of the hose coupling 3 faces the bracket 24 from above in a state where the hose coupling 3 is fixed to the bracket 24 by the fixing member F.

The hose coupling 3 is configured to be able to switch a flow direction of the water discharged from the discharge port 101*b* by being rotated with respect to the discharge port 101*b* while causing the inclined end surface 30 to face the bracket 24 after the fixing by the fixing member F is released. Specifically, the hose coupling 3 is configured to be able to switch between a state in which the water discharged from the discharge port 101*b* flows directly above the discharge port 101*b* and a state in which the water discharged from the discharge port 101*b* flows in a direction inclined by a predetermined angle θ with respect to directly above the discharge port 101*b*.

(Configuration of Impeller)

Figure 2:
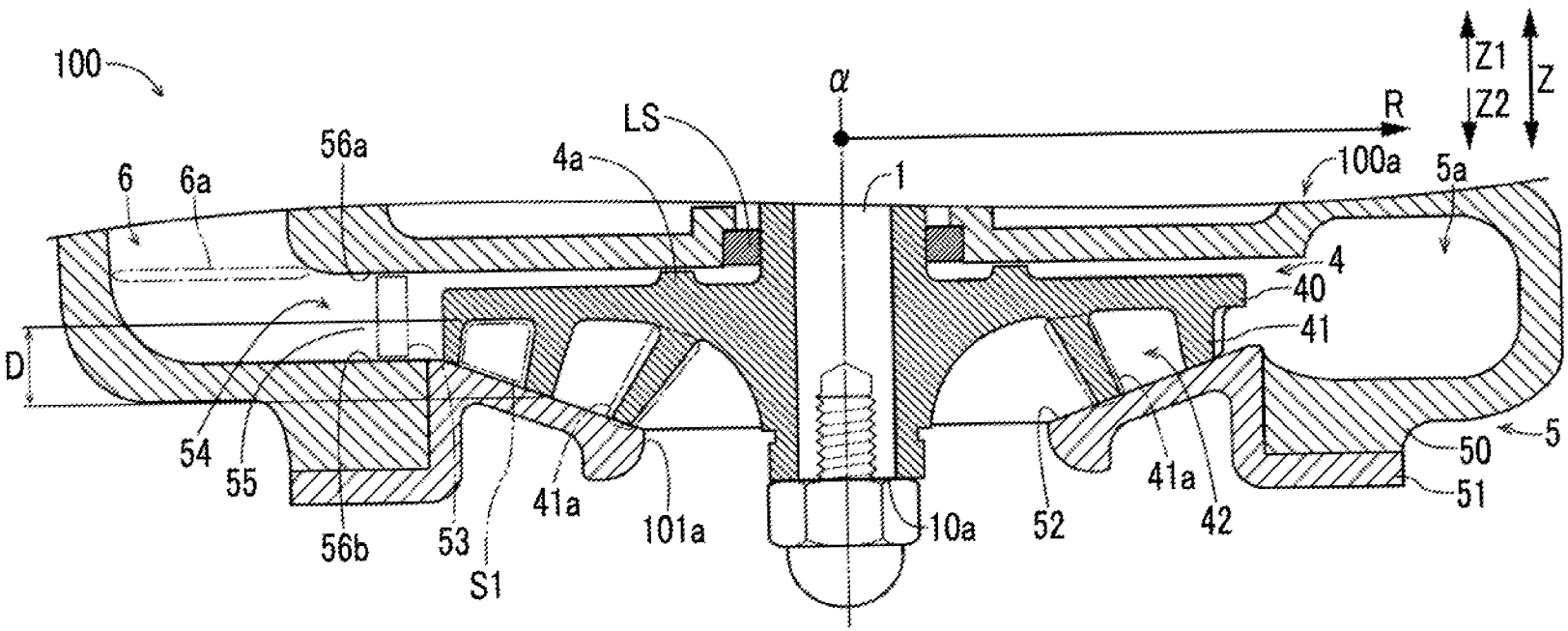
FIG. 2 is an enlarged view of a pump casing and an impeller of FIG. 1.

As illustrated in FIG. 2, the impeller 4 is arranged in the pump chamber 5*a* inside the pump casing 5. The impeller 4 is a semi-open type impeller. That is, the impeller 4 includes a plate-shaped portion (shroud) 40, and a plurality of blade portions (vanes) 41 provided on the suction port 101*a* side (lower side) of the plate-shaped portion 40.

Further, the impeller 4 is provided with a back blade 4*a* on the upper side (side opposite to the blade portion 41 side) of the plate-shaped portion 40. The back blade 4*a* has a function of suppressing a downward load acting on the impeller 4. That is, the back blade 4*a* has a function of suppressing the load acting on the bearing during the pump operation.

Further, a labyrinth seal LS is provided between the impeller 4 and the pump casing 5, and a space 8 is provided between the pump chamber 5*a* and an oil chamber 7. Therefore, it is avoided that the pressure in the pump chamber 5*a* is directly applied to the oil chamber 7. The leakage of water from the pump chamber 5*a* to the space 8 is increased as the pressure in the pump chamber 5*a* is increased, and thus the amount of water discharged from the pump casing 5 is decreased. By arranging the labyrinth seal LS between the pump chamber 5*a* and the space 8, the leakage from the pump chamber 5*a* to the space 8 can be reduced, and thus a large amount of water can be discharged from the pump casing 5 even in a case of the high pressure.

The plate-shaped portion 40 is formed in a circular flat plate shape extending in a direction orthogonal to the Z direction.

The blade portion 41 is formed so that a size D in the axial direction (Z direction) is gradually decreased from the inner peripheral side toward the outer peripheral side of the impeller 4. That is, the impeller 4 (impeller 4) is formed in a mountain shape (arc shape) so that the inner peripheral side of the impeller 4 protrudes downward (Z2 direction) in the side view.

In the blade portion 41, a portion 41*a* on the inner peripheral side of the blade portion 41 is inclined toward the outer peripheral side. That is, the portion 41*a* on the inner peripheral side of the blade portion 41 is inclined so as to be gradually separated from the rotation shaft 1 toward the lower end (end portion in the Z2 direction) of the blade portion 41 from the base of the blade portion 41 connected to the plate-shaped portion 40.

Since the impeller 4 is configured such that the blade width of the blade portion 41 is narrowed toward the outer peripheral side of the impeller 4 in the sectional view (refer to FIG. 2), a flow path sectional area S1 of a waterway 42 formed between the blade portions 41 is formed to be gradually decreased from the inner peripheral side to the outer peripheral side of the impeller 4. That is, the impeller 4 is formed such that a large amount of water can be taken on the inner peripheral side where the water is taken into the waterway 42 between the plurality of blade portions 41 via the suction port 101*a*.

Further, the impeller 4 is formed such that the flow velocity of the water can be increased on the outer peripheral side where the water is discharged from the waterway 42 between the plurality of blade portions 41 to the outside of the impeller 4. Therefore, the submersible pump 100 is configured to be able to increase the total head by vigorously introducing water into the one-sided waterway 6.

(Configuration of Pump Casing)

Figure 3:
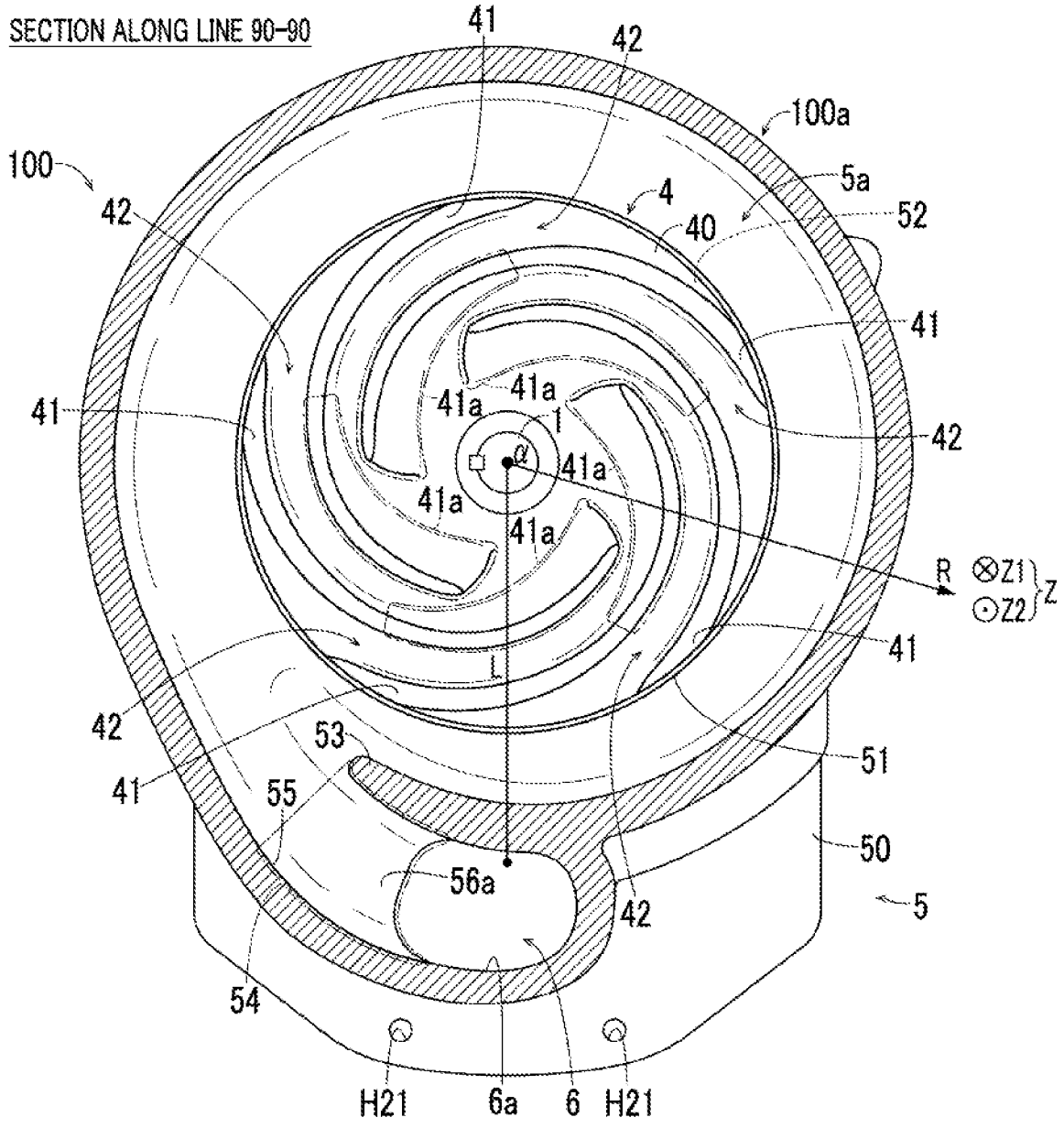
FIG. 3 is a sectional view taken along line 90-90 of FIG. 1.

As illustrated in FIG. 3, in the pump casing 5, the impeller 4 is arranged inside, and the pump chamber 5*a* is provided inside. The pump casing 5 forms a portion of the uppermost stream of the one-sided waterway 6. That is, the pump casing 5 is provided with an inlet opening 6*a* for introducing water from the pump chamber 5*a* into the one-sided waterway 6. In FIG. 3, for convenience of explanation, the pump casing 5 is illustrated in a divided state (section), and the impeller 4 is illustrated in an undivided state.

The pump casing 5 includes a pump casing main body 50, and a suction cover 51 that is detachably attached to the pump casing main body 50.

The suction cover 51 has the suction port 101*a*. The suction cover 51 is removed from the pump casing main body 50 in a case where the impeller 4 is attached to the rotation shaft 1.

A facing surface 52 of the pump casing 5 (suction cover 51) facing the blade portion 41 from below is inclined from the inner peripheral side toward the outer peripheral side of the impeller 4 corresponding to the size of the blade portion 41 in the axial direction, which is gradually decreased from the inner peripheral side toward the outer peripheral side, when viewed from a direction orthogonal to the axial direction (Z direction) of the rotation shaft 1 (in the side view).

That is, the facing surface 52 of the pump casing 5 (suction cover 51) is arranged with a substantially constant relatively small gap from the lower end of the blade portion 41 in the side view. Therefore, the facing surface 52 of the pump casing 5 (suction cover 51) is formed to be inclined along the blade portion 41 which is gradually decreased from the inner peripheral side toward the outer peripheral side of the impeller 4 in the side view.

The pump casing 5 (pump casing main body 50) includes a tongue portion 53 and a connection waterway (throat) 54.

The tongue portion 53 is arranged between the pump chamber in which the impeller 4 is arranged and the inlet opening 6*a* of the one-sided waterway 6 when viewed from the axial direction (Z direction) of the rotation shaft 1. The tongue portion 53 is a spiral cut-off portion for collecting water discharged from the waterway 42 between the blade portions 41 of the impeller 4, in the pump casing 5.

The tongue portion 53 extends toward the upstream side of the inlet opening 6*a* so that the vicinity of the center of the pump chamber 5*a* (near the center axis of rotation α of the rotation shaft 1) is partitioned off from the inlet opening 6*a* of the one-sided waterway 6 when viewed from the axial direction (Z direction) of the rotation shaft 1.

That is, when viewed from the axial direction (Z direction) of the rotation shaft 1, in a case where the center axis of rotation α of the rotation shaft 1 and the inlet opening 6*a* are connected by a straight line L, the pump casing 5 is configured such that the tongue portion 53 is always positioned on the straight line L connecting the center axis of rotation α and the inlet opening 6*a*.

The connection waterway 54 is a waterway connecting the pump chamber 5*a* and the one-sided waterway 6. The connection waterway 54 is provided between the tongue portion 53 and an inner surface 55 of the pump casing 5 when viewed from the axial direction (Z direction) of the rotation shaft 1. The inner surface 55 of the pump casing 5 is arranged on the outer peripheral side of the tongue portion 53 in the radial direction (R direction) of the rotation shaft 1 (impeller 4) when viewed from the axial direction of the rotation shaft 1. The connection waterway 54 is directly connected to the inlet opening 6*a* from the upstream side.

The pump casing 5 includes an upper surface 56*a* that is provided on the other end 10*b* side (Z1 direction side) of the rotation shaft 1 with respect to the connection waterway 54, and forms the connection waterway 54. The upper surface 56*a* forming the connection waterway 54 connects the inner surface 55 of the pump casing 5 and the tongue portion 53 to each other when viewed from the axial direction of the rotation shaft 1. The upper surface 56*a* is an example of a "surface" in the claims.

Further, the pump casing 5 includes a lower surface 56*b* (refer to FIG. 2) that is provided on the one end 10*a* side (Z2 direction side) of the rotation shaft 1 with respect to the connection waterway 54, and forms the connection waterway 54. The connection waterway 54 is formed in a tubular shape connecting the pump chamber 5*a* and the one-sided waterway 6 by being surrounded by the tongue portion 53, the inner surface 55, the upper surface 56*a*, and the lower surface 56*b*.

As illustrated in FIG. 1, the oil chamber 7 is provided between the motor 2 and the pump chamber 5*a*. A mechanical seal 70 and an oil lifter 71 are installed in the oil chamber 7. Further, although not illustrated, an electrode-type water immersion detection unit may be arranged in the oil chamber 7.

The pump casing 5 and the motor frame 22 are in direct contact with each other at a contact portion C on the outer peripheral side of the oil chamber 7 so that the oil chamber 7 is not directly sandwiched between the pump casing 5 and the motor frame 22. Thereby, the submersible pump 100 can reduce the component tolerances that have to be taken into consideration, so that high assemblability can be ensured.

Figure 4:
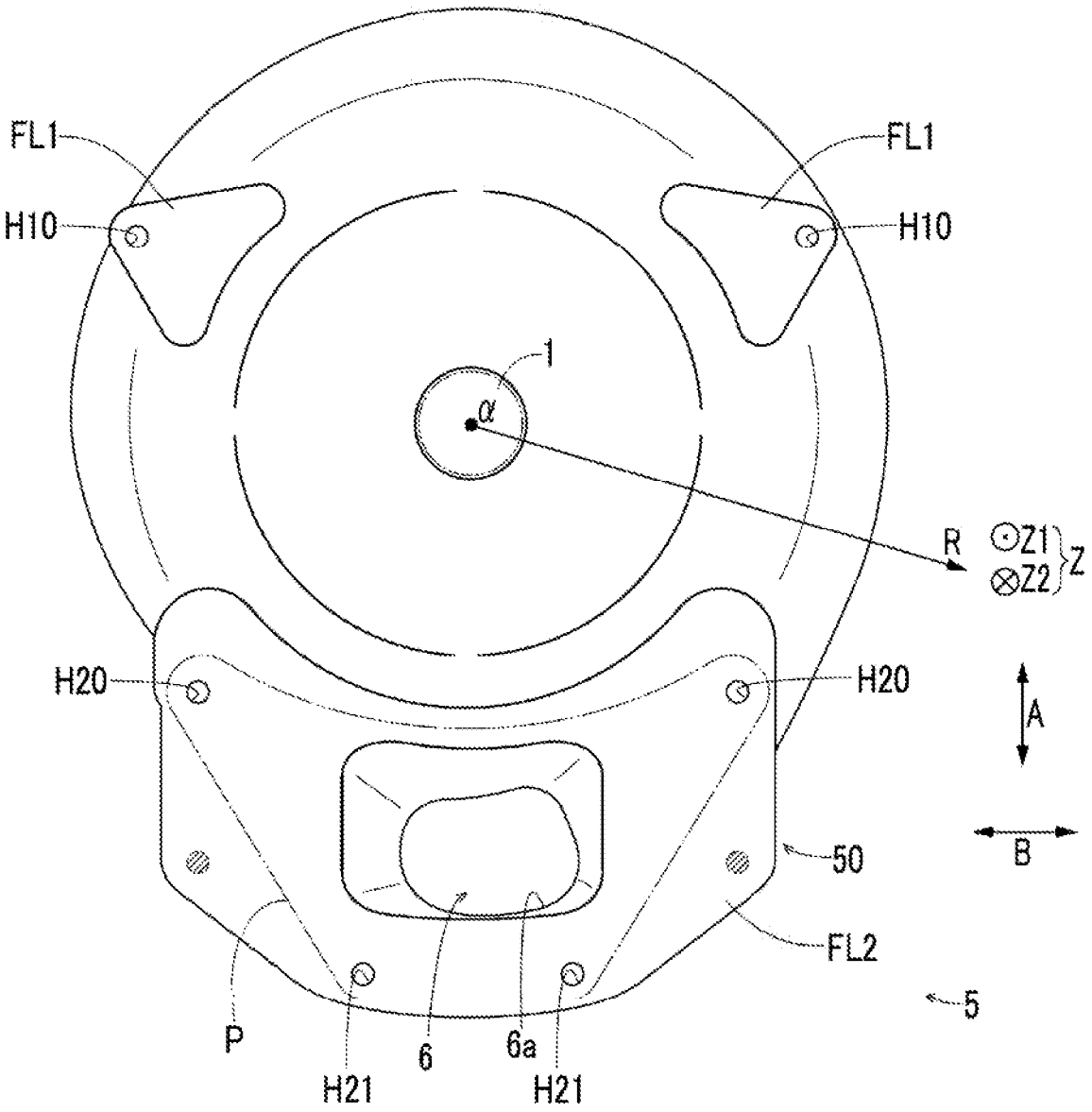
FIG. 4 is a plan view of the pump casing of the submersible pump according to the embodiment.

As illustrated in FIG. 4, a pair of small flange portions FL1 and one large flange portion FL2 (refer to also FIG. 5) are provided at the upper end portion of the pump casing 5. The small flange portions FL1 and one large flange portion FL2 are configured to fix the pump casing 5 to the motor frame 22. Each of the pair of small flange portions FL1 is provided with one screw hole H10 for the attachment of the fixing member. The one-sided waterway 6 is arranged inside the large flange portion FL2 so as to penetrate the large flange portion FL2.

Figure 5:
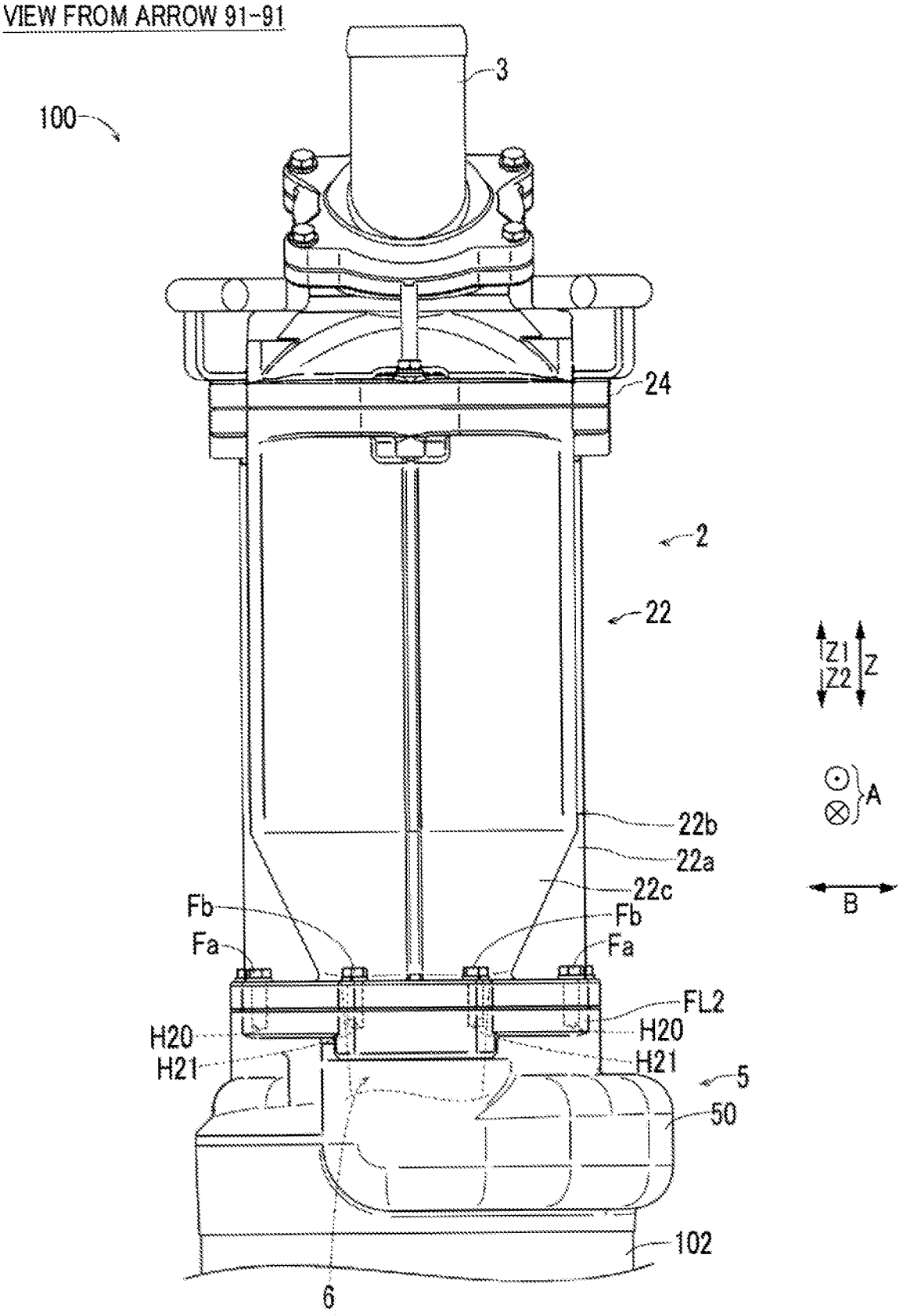
FIG. 5 is a view taken along line 91-91 of FIG. 1.

Here, in FIGS. 4 and 5, a direction in which the rotation shaft 1 and the one-sided waterway 6 are lined up is indicated by an A direction, and a direction orthogonal to the A direction is indicated by a B direction. Both the A direction and the B direction are orthogonal to the Z direction.

The large flange portion FL2 is provided with a pair of screw holes H20 for the attachment of a fixing member Fa (refer to FIG. 5), and a pair of screw holes H21 for the attachment of a fixing member Fb (refer to FIG. 5).

The pair of screw holes H20 are arranged near both end portions of the large flange portion FL2 in the B direction and on the inner peripheral side of the large flange portion FL2.

The pair of screw holes H21 are arranged in the vicinity of the outer peripheral end portion of the large flange portion FL2. Further, the pair of screw holes H21 are arranged inward of the pair of screw holes H20 in the B direction. That is, the pair of screw holes H21 are arranged at positions closer to the one-sided waterway 6 than the pair of screw holes H20 in the B direction. Further, the pair of screw holes H21 are arranged inside a range in which the one-sided waterway 6 is provided, in the B direction.

The arrangement of the screw holes H21 close to the one-sided waterway 6 is realized by a space that is secured around a reduced portion 22*c* of the motor frame 22 (a portion on the Z2 direction side where the external shape of the reduced portion 22*c* becomes smaller) which will be described later, by the reduced portion 22C. Further, the space secured around the reduced portion 22*c* enables the insertion (attachment) of the fixing members Fa and Fb from above (motor frame 22).

In this way, in the submersible pump 100, since the pump casing 5 and the motor frame 22 are fixed by the fixing member Fa at a position close to the one-sided waterway 6, water leakage from between the pump casing 5 and the motor frame 22 can be effectively suppressed by firmly fixing the pump casing 5 and the motor frame 22.

Here, packing P is installed between the pump casing 5 and the motor frame 22 in a range indicated by the two-dot chain line. As illustrated in FIG. 4, in the submersible pump 100, since the screw holes at the outer peripheral end portion of the large flange portion FL2 are provided at the positions indicated by H21, an area required for the packing P can be decreased as compared with a case where the screw holes are provided near the positions indicated by hatching in FIG. 4, and thus the pressure applied to the packing P can be made larger than the pressure in the related art. As a result of optimizing the position of the screw holes by providing the reduced portion 22*c*, the submersible pump 100 can secure a watertight state by the packing P more reliably than that in the related art.

(Configuration of One-Sided Waterway)

As illustrated in FIG. 1, the one-sided waterway 6 is formed so that a flow path sectional area S2 is gradually decreased from the downstream side toward the inlet opening 6*a* on the upstream side. In other words, the one-sided waterway 6 is formed in a widening shape in which the flow path sectional area S2 is gradually increased from the inlet opening on the upstream side toward the downstream side.

Specifically, the one-sided waterway 6 is formed to straddle the motor frame 22 and the pump casing 5 as described above, and is formed such that the flow path sectional area S2 is gradually decreased from the motor frame 22 on the downstream side toward the pump casing 5 on the upstream side.

That is, the one-sided waterway 6 is formed so that a path through which water passes is narrowed in the vicinity of the inlet opening 6*a*. Therefore, the one-sided waterway 6 can increase the flow velocity of water in the vicinity of the inlet opening 6*a*. As described above, the submersible pump 100 is configured to be able to increase the total head by being formed to vigorously introduce water into the one-sided waterway 6.

The motor frame 22 is provided with the reduced portion 22*c* of which the external shape is gradually decreased from the downstream side toward the upstream side along with the flow path sectional area of the one-sided waterway 6 being gradually decreased from the motor frame 22 on the downstream side toward the pump casing 5 on the upstream side (refer to FIG. 5). The reduced portion 22*c* is a lower portion of the frame portion 22*b*. In this way, it is possible to improve the pump performance by providing the reduced portion 22*c* in which the flow path is narrowed, and it is possible to increase an area in which the water flowing through the flow path is in contact with the component inside the motor 2 and improve the cooling performance for the motor 2 by providing the frame 22*b* in which the width of the flow path is widened.

An inner surface 60 of the one-sided waterway 6 is formed in a smooth shape without a step (smoothed shape) between the motor frame 22 and the discharge port 101*b*. That is, the inner surface 60 of the one-sided waterway 6 is formed in a smooth shape without a step in a portion of the downmost stream provided in the bracket 24.

The inner surface 60 of the one-sided waterway 6 is also formed in a smooth shape without a step in a portion on the upstream side provided in the pump casing 5 and the motor frame 22. As described above, the submersible pump 100 is configured to be able to increase the total head by forming the inner surface 60 in a smooth shape without a step and reducing the energy loss of water in the one-sided waterway 6.

(Effect of Embodiment)

In the present embodiment, the following effects can be obtained.

In the present embodiment, as described above, the pump casing 5 is provided with the tongue portion 53 which is arranged between the pump chamber 5*a* in which the impeller 4 is arranged and the inlet opening 6*a* of the one-sided waterway 6 when viewed from the axial direction of the rotation shaft 1, and the connection waterway 54 which is arranged between the tongue portion 53 and the inner surface 55 of the pump casing 5 is directly connected to the inlet opening 6*a* from the upstream side when viewed from the axial direction of the rotation shaft 1. Thereby, the pump chamber 5*a* and the one-sided waterway 6 can be connected to each other via the connection waterway 54. Therefore, as compared with a case where the pump chamber 5*a* and the one-sided waterway 6 are directly connected, in the connection waterway 54 provided immediately before the one-sided waterway 6, since the water flow (flow path sectional area) is narrowed down and the water flow is regulated, water can smoothly flow into the one-sided waterway 6 at a faster speed. As a result, the total head of the submersible pump 100 can be further increased.

In the present embodiment, as described above, the one-sided waterway 6 is formed so that a flow path sectional area S2 is gradually decreased from the downstream side toward the inlet opening 6*a* on the upstream side. Thereby, in the inlet opening 6*a* of the one-sided waterway 6, the water flow (flow path sectional area S2) can be narrowed down, so that water can flow into the one-sided waterway 6 at a faster speed. Further, by changing the flow path sectional area S2 of the one-sided waterway 6 so that the flow path sectional area S2 is gradually decreased instead of being suddenly changed, it is possible to suppress the water flow from being disturbed by the sudden change of the flow path sectional area S2. As a result, the total head of the submersible pump 100 can be further increased.

In the present embodiment, as described above, the motor 2 including the motor frame 22 provided to the pump casing 5 from a side opposite to the suction port 101*a* in the axial direction is further provided, and the one-sided waterway 6 is formed to straddle the motor frame 22 and the pump casing 5, and is formed such that the flow path sectional area S2 is gradually decreased from the motor frame 22 on the downstream side toward the pump casing 5 on the upstream side. Thereby, not only the one-sided waterway 6 provided in the pump casing 5 but also the one-sided waterway 6 provided in the motor frame 22 can be formed so that the flow path sectional area S2 is gradually decreased, and therefore, the one-sided waterway 6 can be formed over a relatively large range such that the flow path sectional area S2 is gradually decreased. Therefore, a sudden change of the flow path sectional area S2 can be further suppressed, and thus the total head of the submersible pump 100 can be further increased.

In the present embodiment, as described above, the impeller 4 includes the plate-shaped portion 40, and the blade portion 41 provided on the suction port 101*a* side of the plate-shaped portion 40, and the blade portion 41 is formed such that the portion on the inner peripheral side of the blade portion 41 is inclined toward the outer peripheral side. Thereby, on the inner peripheral side of the blade portion 41, a larger opening portion on the inner peripheral side where water is first taken into a portion between the blade portions 41 via the suction port 101*a* can be secured by inclining the blade portion 41 toward the outer peripheral side. Therefore, the loss on the large flow rate side can be reduced by improving the suction performance, and the lift on the large flow rate side can be increased.

In the present embodiment, as described above, the blade portion 41 is formed such that the size D of the blade portion 41 in the axial direction is gradually decreased from the inner peripheral side toward the outer peripheral side of the impeller 4, and the facing surface 52 of the pump casing 5 facing the blade portion 41 is inclined from the inner peripheral side toward the outer peripheral side of the impeller 4 corresponding to the size D of the blade portion 41 in the axial direction, which is gradually decreased, when viewed from a direction orthogonal to the axial direction. Thereby, the loss can be reduced by changing an area ratio between the inlet side and the outlet side in the pump casing 5, and therefore the total head of the submersible pump 100 can be further increased.

In the present embodiment, as described above, the impeller 4 is formed such that the flow path sectional area S1 of the waterway 42 formed between the blade portions 41 is gradually decreased from the inner peripheral side toward the outer peripheral side of the impeller 4. Thereby, the outer diameter of the impeller 4 can be increased by making the blade width on the outer peripheral side (outlet side) smaller than the blade width on the inner peripheral side (inlet side), and therefore the total head of the submersible pump 100 in the small flow rate range can be further increased.

In the present embodiment, as described above, the motor 2 including the motor frame 22 provided to the pump casing 5 from a side opposite to the suction port 101*a* in the axial direction is further provided, and the inner surface 60 of the one-sided waterway 6 is formed in a smooth shape without a step between the motor frame 22 and the discharge port 101*b*. Thereby, unlike a case where there is a step, it is possible to prevent the water flow passing through the one-sided waterway 6 from being disturbed, and thus the total head of the submersible pump 100 can be further increased.

In the present embodiment, as described above, the tongue portion 53 extends toward the upstream side of the inlet opening 6*a* so that the vicinity of the center of the pump chamber 5*a* is partitioned off from the inlet opening 6*a* of the one-sided waterway 6 when viewed from the axial direction of the rotation shaft 1. Thereby, the connection waterway 54 can be arranged to extend in a direction along the water flow generated in the pump chamber 5*a* by the impeller 4 instead of in a direction in which the vicinity of the center of the pump chamber 5*a* and the inlet opening 6*a* of the one-sided waterway 6 are directly connected. Therefore, water can flow smoothly from the pump chamber 5*a* to the connection waterway 54 at a higher speed, and therefore, the total head of the submersible pump 100 can be further increased.

In the present embodiment, as described above, the pump casing 5 includes the upper surface 56*a* that is provided on the other end 10*b* side of the rotation shaft 1 with respect to the connection waterway 54, and forms the connection waterway 54, and the upper surface 56*a* forming the connection waterway 54 connects the tongue portion 53 and the inner surface 55 of the pump casing 5 to each other when viewed from the axial direction of the rotation shaft 1. Thereby, the number of components can be reduced and the device configuration can be simplified as compared with a case where the upper surface that forms the connection waterway by connecting the tongue portion 53 and the inner surface 55 of the pump casing 5 when viewed from the axial direction of the rotation shaft 1 is configured by a lid-shaped separate member different from the pump casing.

In the present embodiment, as described above, the motor frame 22 is provided with the reduced portion 22*c* of which the external shape is gradually decreased from the downstream side toward the upstream side along with the flow path sectional area S2 of the one-sided waterway 6 being gradually decreased from the motor frame 22 on the downstream side toward the pump casing 5 on the upstream side. Thereby, the fixing member Fa for the pump casing 5 and the motor frame 22 can be arranged at a position closer to the one-sided waterway 6, by the space around the reduced portion 22*c*, which is secured on the pump casing 5 side by the reduced portion 22*c*. Therefore, water leakage from between the pump casing 5 and the motor frame 22 can be effectively suppressed by firmly fixing the pump casing 5 and the motor frame 22.

(Modification)

It should be noted that the embodiments disclosed here are exemplary in all respects and are not considered to be restrictive. The scope of the present invention is illustrated by the scope of claims rather than the description of the above-described embodiments, and further includes all changes (modifications) within the meaning and scope equivalent to the scope of claims.

For example, the length of the tongue portion illustrated in the above embodiment is only an example, the tongue portion may be formed longer than the example illustrated in FIG. 3, and the tongue portion may be formed shorter than the example illustrated in FIG. 3 in a state where the connection waterway is reliably provided.

Further, in the above embodiment, an example is illustrated in which the one-sided waterway is formed such that the flow path sectional area is gradually decreased from the downstream side to the inlet opening on the upstream side, but the present invention is not limited thereto. In the present invention, the one-sided waterway may be formed such that the flow path sectional area is gradually increased or is not changed from the downstream side to the inlet opening on the upstream side.

Further, in the above embodiment, an example is illustrated in which the portion on the inner peripheral side of the blade portion is inclined toward the outer peripheral side, but the present invention is not limited thereto. In the present invention, the portion on the inner peripheral side of the blade portion may be formed to extend downward without being inclined toward the outer peripheral side.

Further, in the above embodiment, an example is illustrated in which the impeller is formed such that the size of the blade portion in the axial direction is gradually decreased from the inner peripheral side toward the outer peripheral side of the impeller, but the present invention is not limited thereto. In the present invention, the impeller may be formed such that the size of the blade portion in the axial direction is constant.

Further, in the above embodiment, an example is illustrated in which the facing surface of the pump casing facing the blade portion is inclined when viewed from a direction orthogonal to the axial direction, but the present invention is not limited thereto. In the present invention, the facing surface may be formed to extend in the horizontal direction.

Further, in the above embodiment, an example is illustrated in which the impeller is formed such that the flow path sectional area of the waterway formed between the blade portions is gradually decreased from the inner peripheral side toward the outer peripheral side of the impeller, but the present invention is not limited thereto. In the present invention, the impeller may be formed such that the flow path sectional area of the waterway formed between the blade portions has a constant size without being changed from the inner peripheral side toward the outer peripheral side of the impeller.

Further, in the above embodiment, an example is illustrated in which a semi-open type impeller is used as the impeller, but the present invention is not limited thereto. In the present invention, a closed impeller may be used.

REFERENCE SIGNS LIST

1: rotation shaft
2: motor
4: impeller
5: pump casing
5*a*: pump chamber
6: one-sided waterway
6*a*: inlet opening
10*a*: one end (of rotation shaft)
10*b*: the other end (of rotation shaft)
22: motor frame
22*c*: reduced portion (of motor frame)
40: plate-shaped portion
41: blade portion
42: waterway (formed between blade portions)
52: facing surface
53: tongue portion
54: connection waterway
55: inner surface (of pump casing)
56*a*: upper surface (surface)
60: inner surface (of one-sided waterway)
100: submersible pump
100*a*: submersible pump main body
101*a*: suction port
101*b*: discharge port

The invention claimed is:

1. A submersible pump in which a one-sided waterway extending along a rotation shaft is provided on one side of a submersible pump main body, the submersible pump comprising:

an impeller attached to one end of the rotation shaft; and a pump casing in which the impeller is arranged, wherein the pump casing includes a tongue portion that is arranged between a pump chamber in which the impeller is arranged and an inlet opening of the one-sided waterway when viewed from an axial direction of the rotation shaft, and a connection waterway that is provided between the tongue portion and an inner surface of the pump casing, and is directly connected to the inlet opening of the one-sided waterway from an upstream side when viewed from the axial direction of the rotation shaft, the submersible pump further comprises a motor including a motor frame provided to the pump casing from a side opposite to a suction port in the axial direction of the rotation shaft, the motor frame includes a first frame portion forming a motor chamber inside, and a second frame portion forming a portion of the one-sided waterway, the second frame portion of the motor frame is provided with a reduced portion of which an external shape is decreased from a downstream side toward the upstream side along with a flow path sectional area of the one-sided waterway being continuously decreased from the motor frame on the downstream side toward the pump casing on the upstream side, and an arrangement space for a plurality of fixing fasteners for fixing the pump casing and the motor frame is provided to surround the reduced portion.

2. The submersible pump according to claim 1, wherein an inner surface of the one-sided waterway is formed without a discontinuous change in the flow path sectional area between the motor frame and a discharge port.

3. The submersible pump according to claim 1, wherein the tongue portion extends toward the upstream side so that a vicinity of a center of the pump chamber is partitioned off from the inlet opening of the one-sided waterway when viewed from the axial direction of the rotation shaft.

4. The submersible pump according to claim 1, wherein the pump casing includes a surface that is formed on an other end side of the rotation shaft with respect to the connection waterway, and forms the connection waterway, and the surface forming the connection waterway connects the tongue portion and the inner surface of the pump casing to each other when viewed from the axial direction of the rotation shaft.

5. The submersible pump according to claim 1, wherein the one-sided waterway is formed such that the flow path sectional area is continuously decreased from the downstream side toward the inlet opening of the one-sided waterway on the upstream side.

6. The submersible pump according to claim 5, wherein the one-sided waterway is formed to straddle the motor frame and the pump casing.

7. The submersible pump according to claim 1, wherein the impeller includes a plate-shaped portion, and a blade portion provided on a suction port side of the plate-shaped portion, and a portion on an inner peripheral side of the blade portion is inclined toward an outer peripheral side of the impeller.

8. The submersible pump according to claim 7, wherein the blade portion is formed such that a size of the blade portion in the axial direction of the rotation shaft is decreased from an inner peripheral side of the impeller toward the outer peripheral side of the impeller, and a facing surface of the pump casing facing the blade portion is inclined from the inner peripheral side of the impeller toward the outer peripheral side of the impeller.

9. The submersible pump according to claim 7, wherein the blade portion includes a plurality of blade portions, and the impeller is formed such that a flow path sectional area of a waterway formed between the plurality of blade portions is decreased from the inner peripheral side of the impeller toward the outer peripheral side of the impeller.

* * * * *